US005730848A

United States Patent [19]

Daky

[11] Patent Number: 5,730,848

[45] Date of Patent: Mar. 24, 1998

[54] CONTINUOUS-ACTION REFERENCE ELECTRODE FOR THE CATHODIC PROTECTION OF METALLIC STRUCTURES

[75] Inventor: Nikolai Vasilyevich Daky, Poselok Razvilka, Russian Federation

[73] Assignee: Chameleon Investments Limited, Isle of Man

[21] Appl. No.: 403,714

[22] PCT Filed: Sep. 18, 1992

[86] PCT No.: PCT/GB92/01724

§ 371 Date: Aug. 6, 1996

§ 102(e) Date: Aug. 6, 1996

[87] PCT Pub. No.: WO94/06951

PCT Pub. Date: Mar. 31, 1994

[51] Int. Cl.[6] ..... G01N 27/26

[52] U.S. Cl. ..... 204/435; 204/404; 204/290 F; 204/292; 204/293

[58] Field of Search ..... 204/404, 435, 204/292, 290 F, 293; 205/775.5, 776

[56] References Cited

U.S. PATENT DOCUMENTS

| | | | |
|---|---|---|---|
| 4,994,159 | 2/1991 | Agarwala et al. | 204/404 |
| 5,216,370 | 6/1993 | Bushman et al. | 204/404 |

*Primary Examiner*—Bruce F. Bell

*Attorney, Agent, or Firm*—Dickstein Shapiro Morin & Oshinsky LLP

[57] ABSTRACT

The invention relates to the field of cathodic protection of underground or underwater metallic structures. The reference electrode object of the invention has a plate-shaped support (1) made of porous ceramic material on which support (1) flat faces copper plates (2) alternated with titanium plates (3) or with nickel-based alloy plates are applied by means of plasma-coating or potting. The copper plates (2) are isolated from the nickel plates. On one of the lateral faces of the porous ceramic support (1) a metal membrane (6) is applied, constituting an electrochemical potential transducer.

9 Claims, 9 Drawing Sheets

CONTINUOUS-ACTION REFERENCE ELECTRODE FOR THE CATHODIC PROTECTION OF METALLIC STRUCTURES

DESCRIPTION

This application is a 371 of PCT/GB92/01724 filed on Sep. 18, 1992.

The invention concerns a continuous-action reference electrode for the cathodic protection of metallic structures.

The invention relates to the field of techniques for the protection of underground and underwater plants from electrochemical corrosion.

The reference electrode is predisposed for the measurement of the polarised potential of the plant and can be used for the measurement of the corrosion and also for the automatic control of the cathodic protection station.

Some prior art continuous-action reference electrodes are composed of two metallic pivots of different metals having high chemical purity, placed in mutual contact at a point where the connection cable is also connected, which cable leads to the cathodic protection station.

The said pivots are generally made of antimony and bismuth and are covered with the oxides of the above metals.

Another type of reference electrode in the prior art is composed of two magnesium cylinders with an iron, copper of nickel pivot inside.

The cylinder and the pivot are mutually insulated with insulator compound and their point of mutual contact is on a surface of the head, where they both also contact the connection cable.

Common defects of the reference electrodes described above are high metal consumption and low internal conductivity which prevents use in dry environments with high impedance.

In such cases, in order to increase the conductivity of the electrode, it is necessary to increase its size, leading to a high consumption of metal as well as to high costs.

A further type of prior art reference electrode comprises a ceramic box element, filled with high-viscosity electrolyte, in which a copper pivot-shaped electrode is inserted.

The connection cable is welded to the copper pivot.

On the external surface of the ceramic element an electrochemical potentiometric end instrument is attached, consisting of a steel plate with a surface of 625 mm, to which plate another connection cable is welded.

This type of reference electrode also has several drawbacks, such as a high specific consumption of metal and the need for periodic maintenance for filling the ceramic element with new electrolyte due to the inevitable consumption of the said electrolyte.

Furthermore, the measurement precision of the electrochemical potential by means of the relative steel end instrument is not high due to the difference of the chemical composition of the steel plate in the end instrument and of the material of the underground metal plant to be protected.

The reference electrode can be installed only in a vertical position and thus its field of application is limited particularly with regard to large-diameter piping.

Still further, the said reference electrode can be used only when the ground temperature is above 0°.

A principal aim of the present invention is to perfect the precision of electrochemical potential measurement and to reduce the maintenance costs of the plant.

A further aim is to economise on the costs of the reference electrode with regard to the specific consumption of metal.

These and other are all at least partially attained by a continuous-action reference electrode for the cathodic protection of metallic structures, object of the present invention characterised in that the electrode: comprises a support (1) substantially plate-shaped and made of ceramic material porous to electrolyte having the function of a base for a copper plate (2) having the function of an electrode, situated on both flat faces of the said ceramic support (1) and of a titanium plate (3) having the function of an electrode, isolated from the said copper plate (2) on both flat faces; the electric connection for both said plates (2), (3) being realised by means of connection to a further copper plate applied on a lateral face of the said support (1), the arrangement of the said copper and titanium plate (2), (3) on the first surface of the said support (1) in such a way that a copper plate (2) on a flat surface corresponds to a titanium plate (3) on an opposite surface, with a metal membrane (6) constituting a electrochemical potential transducer being situated on a lateral face of the support (1) and being electrically isolated from the other metal plates of the said support (1), said membrane being made of the same material as the metallic structure(s).

The total surface of the said copper plates (2) may be more that the total surface of the titanium plates (3) by 1.4 to 1.8 times.

The plate shaped support (1) may be made of porous ceramic material of the Sital type.

The said plates (2) and (3) may be flat-spiral shaped, the said spirals being split into spiral couples, one spiral of the said couples being of copper and one of titanium, each spiral of the said couples being of different length and width and being connected together and to a coupling cable (5); said couples of spirals being situated on two flat surfaces of the said support (1) in such a way that one copper spiral on one flat surface of the said support (1) corresponds to one titanium spiral situated on a flat surface of the opposite face of said support (1).

The reference electrode may further comprise a first and second group of contacts, respectively (7) and (4), made in a conical hole situated between two adjacent faces of the support (1) and below a corner of the said support (1), for which reason the conical hole interior part is covered with a layer of copper to which is welded an electroductor wire for the first and second coupling cables to a cathodic protection station; the chamber constituted by the conical hole being filled with an isolating compound.

The said first and second group of contacts may be made in a groove situated on a lateral face of the said support (1), the groove internal surface being covered with copper to which copper is soldered on electroconductor wire of the first and the second coupling cables (5), the said groove being filled with an isolating compound.

One of the plates functioning as electrodes arranged on the flat surface of the support (1) made of porous ceramic material may instead be made of a nickel-based alloy.

The said copper and titanium or nickel-based alloy plates (2) and (3) may be applied to the ceramic support (1) by means of a plasma process or by means of potting or another type of coating aimed at creating a uniform thickness over the surface.

The aforementioned aims and other besides will better emerge from the detailed description which follows, of some preferred embodiments illustrated in the form of non-limiting examples in the accompanying drawings, in which.

Figure 12:
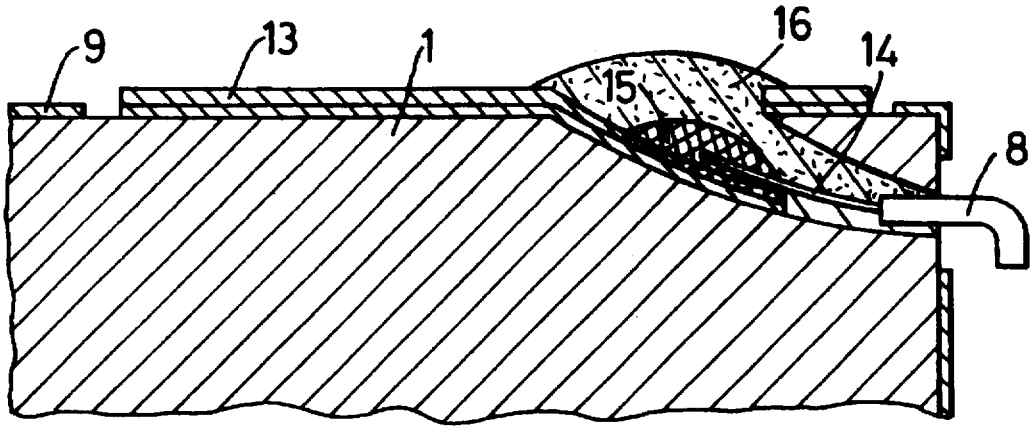
Figure 13:
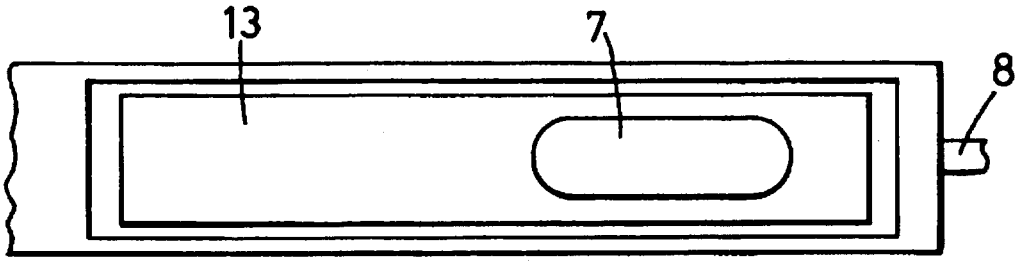
Figure 14:
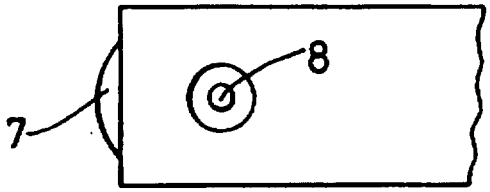
Figure 15:
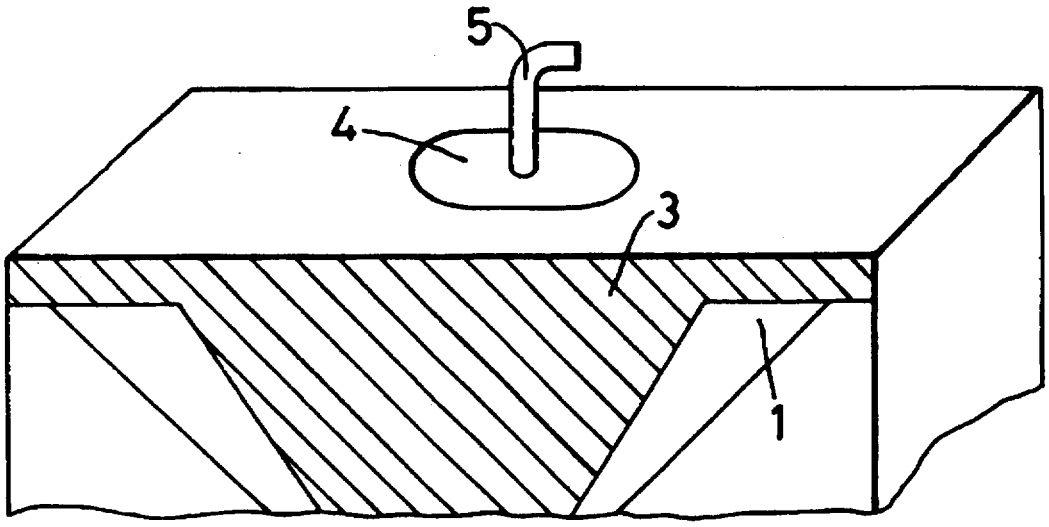
Figure 16:
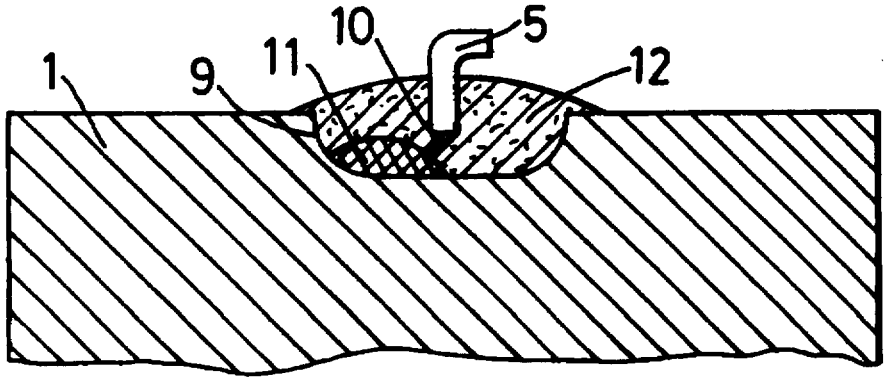
Figure 17:
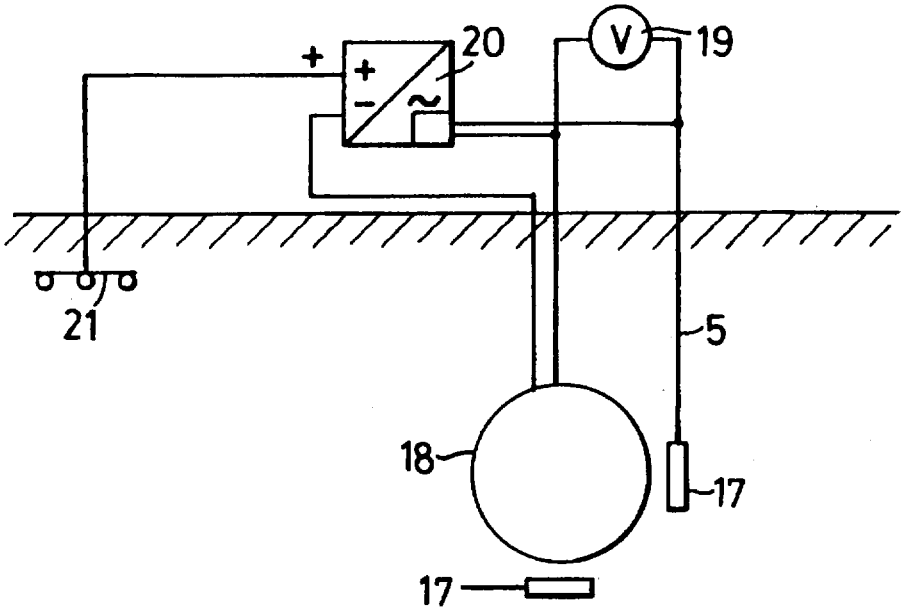
Figure 18:
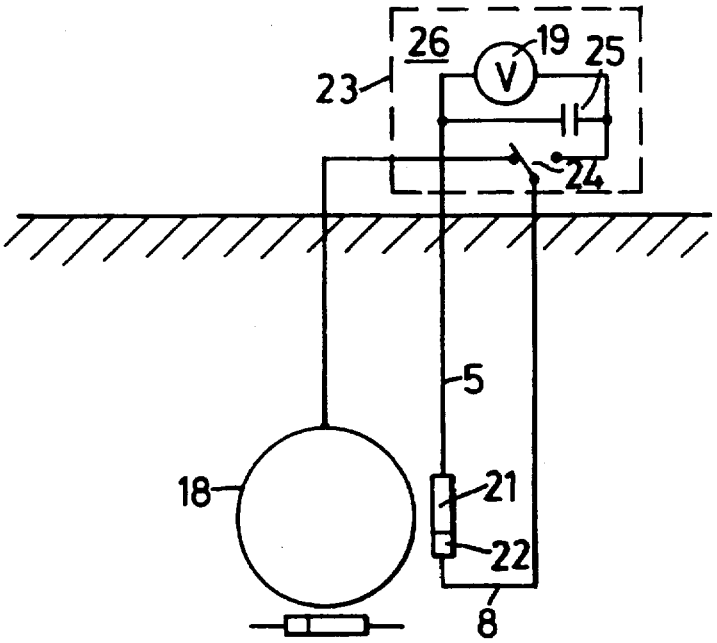
Figure 19:
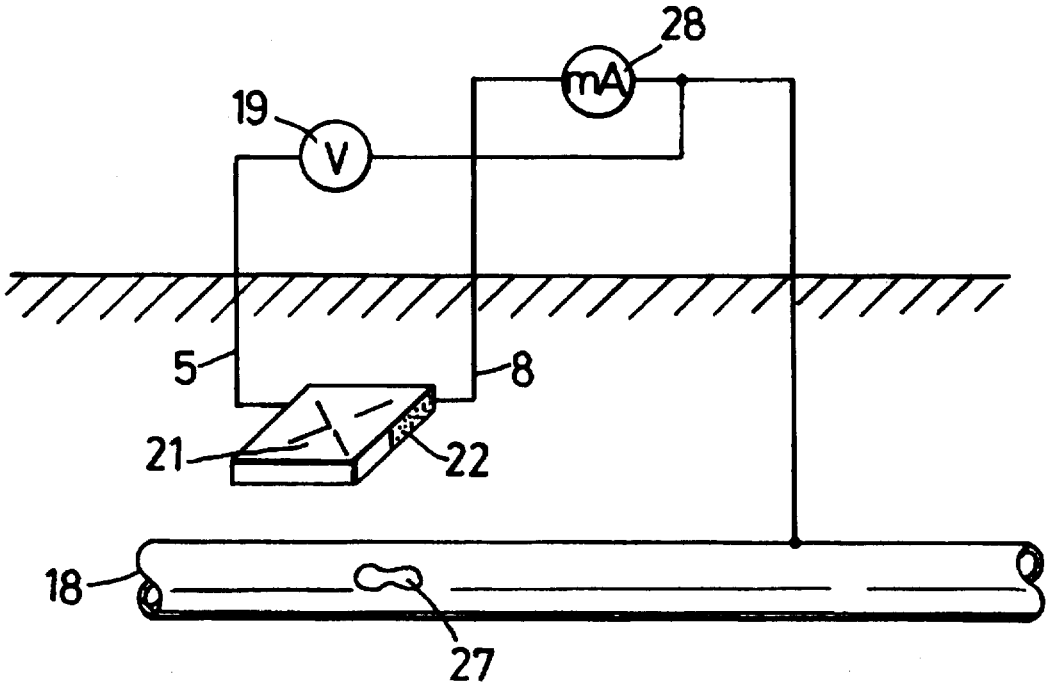

FIGS. 8, 9 10 and 11 show a second embodiment of the construction of the contact point of the reference electrode;

FIGS. 12, 13 and 14 show the construction of the electrochemical potential transducer and of the contact point of the reference electrode;

FIGS. 15 and 16 show the arrangement of the contact point on the surface of the support head between the two faces of the reference electrode;

FIG. 17 shows the arrangement of potential measurement and cathodal protection station control electrode in the earth;

FIG. 18 shows the arrangement diagram of the reference electrode and the measurement of the polarising potential by the pulse commutation method; and FIG. 19 shows the arrangement and wiring diagram of the reference electrode for the determination of the efficiency of cathodic protection on an insulating fault.

Figure 1:
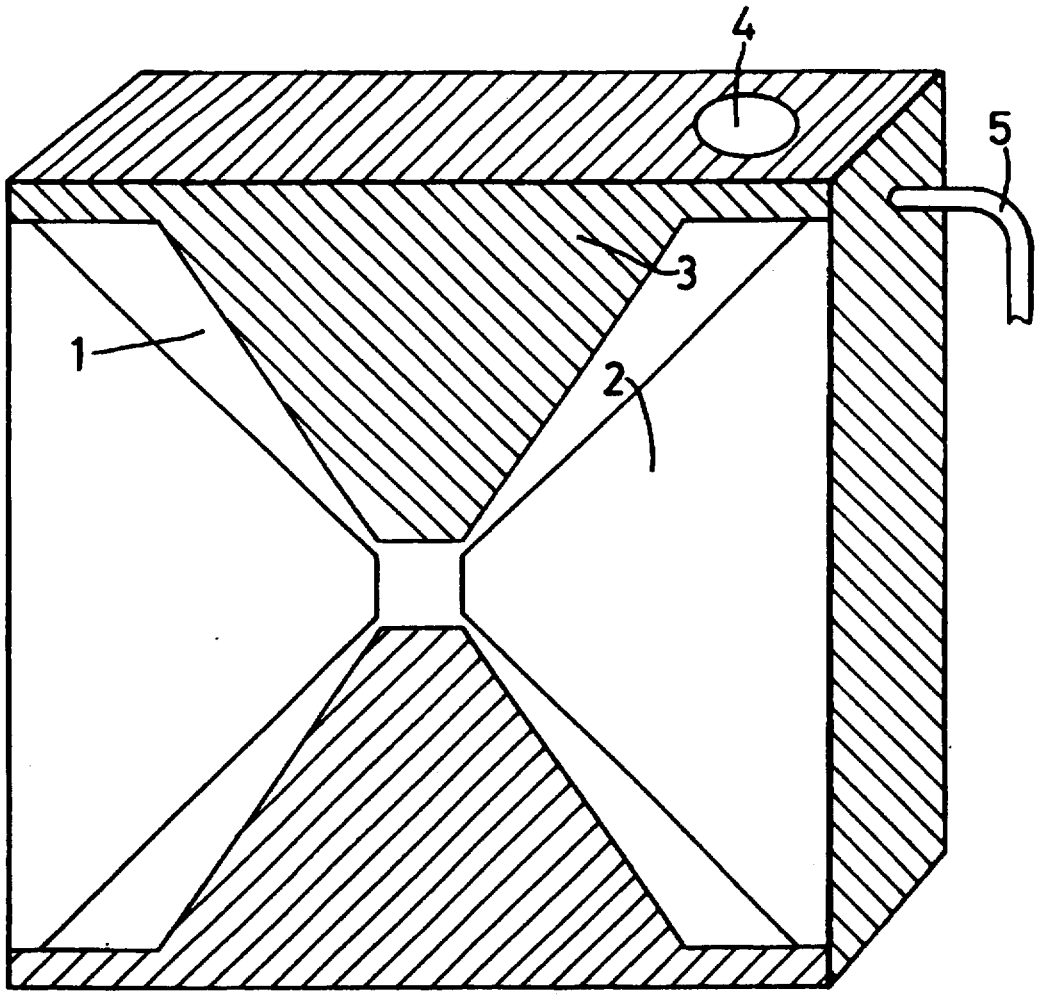
FIG. 1 shows a general view of a first embodiment of the electrode without the electro-chemical potential transducer.
Figure 2:
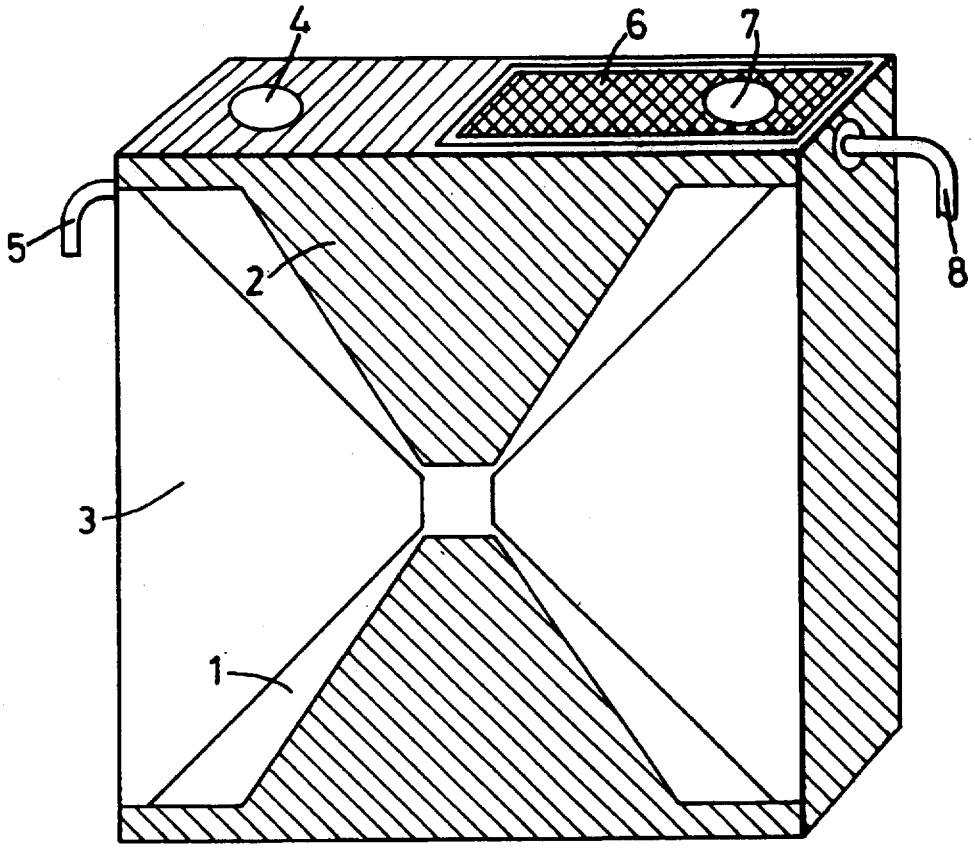
FIG. 2 shows the electrode of FIG. 1 with an electrochemical potential transducer.
Figure 3:
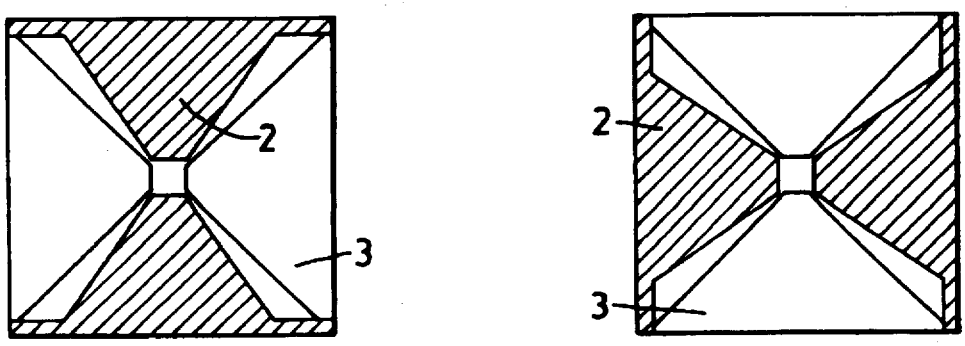
FIG. 3 shows the arrangement diagram of the sputtered plasma electrodes on the opposite ends of the support.

With reference to FIGS. 1 to 3 and the first embodiment of the electrode illustrated therein, 1 denotes a rectangular body, substantially plate-shaped and made of porous sital, that is of a ceramic material having a porosity of between 2–50 percent volume.

On each face of the plate, metal plates 2 and 3 are arranged, which plates constitute electrodes. The plates 2 are made of copper, while the plates 3 are made of titanium.

Both metal plates 2 and 3 are plasma-coated either by hot spraying or by vacuum deposition, or by means of another constant-thickness coating system. On a lateral surface of the plate-shaped support 1 a first contact point 4 with the coupling cable 5 is installed.

The metal plates 2 and 3 are alternated on each surface of the support 1.

Apart from this, the reciprocal arrangement of the metal plates 2 and 3 on the opposite sides of the support 1 are alternated in such a way that if a copper plate 2 is arranged on one side of a support 1, on the other surface of the said support 1 a plate of titanium will be arranged, and vice-versa.

The reference electrode with the electrochemical potentiometer end instrument, apart from the copper plate 2 and the titanium plate 3 alternately situated on the surfaces of the support 1, contains a metal membrane 6, a contact group 7 for the electrochemical potential transducer with the second coupling cable 8, as is illustrated in FIG. 2.

The arrangement of the copper plates 2 and the titanium plates 3 on the opposite faces of the rectangular base or support 1 is represented in FIG. 3.

The metal membrane 6 of the electrochemical potential transducer is made from the same material as the underground plant to be protected, and is applied by means of cathodic action.

Figure 4:
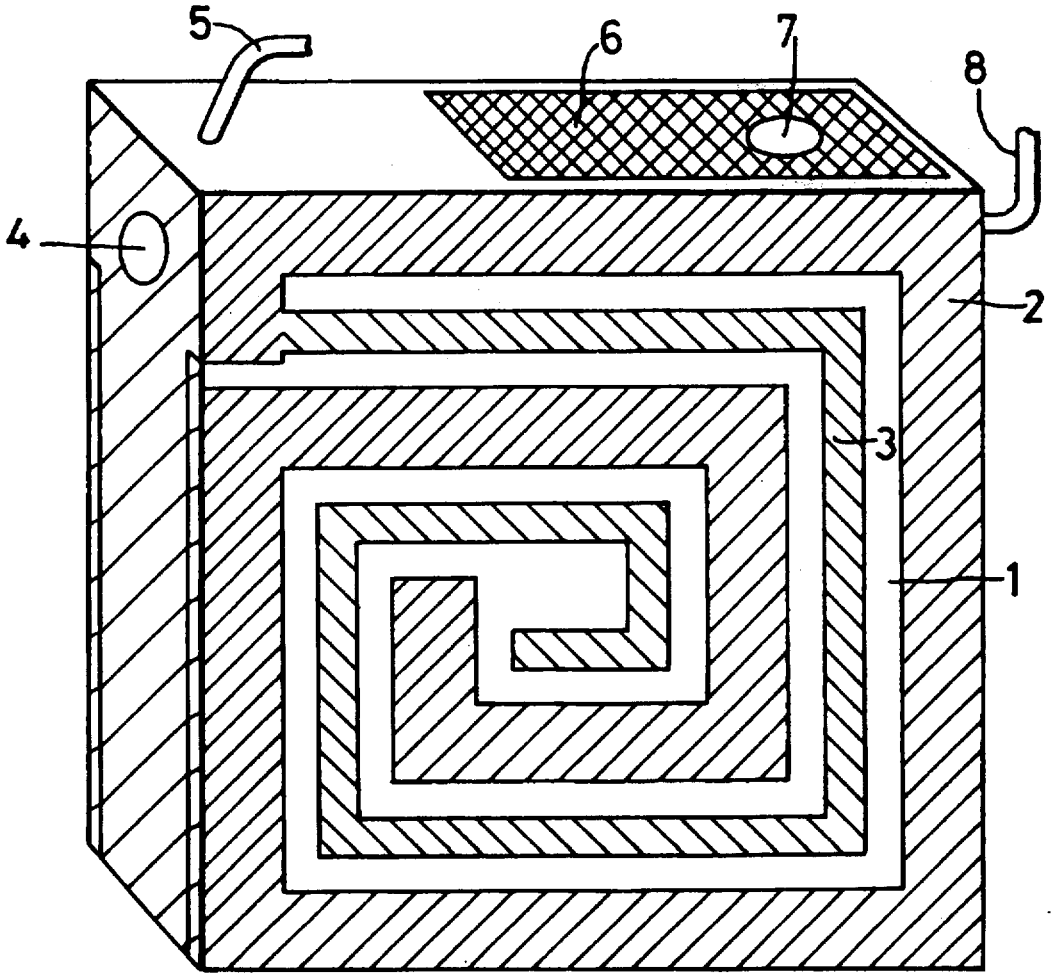
FIG. 4 shows a second embodiment of the reference electrode with the electrochemical potential transducer and electrodes arranged on a spiral path.

Referring to FIG. 4 there is illustrated a second embodiment of the electrode. This reference electrode with the electrochemical potential transducer (see FIG. 4) contains the continuous-belt electrodes made of copper 2 and titanium 3 plasma-coated on both surfaces of the ceramic support 1.

The belt-electrodes 2 and 3 are flat-spiral shaped, have different length and width and are situated on the opposite faces of the support 1 in such a way that the copper 2 belt, on the one side, corresponds to the titanium 3 belt of the same width on the opposite surface of the support 1.

Both belts are coupled between themselves as well as with the second coupling cable 8.

The contact point 4 contains the first coupling cable 5 and is situated on one of the lateral faces of the support 1.

All of the support 1 faces are copper-plated with copper of a high degree of chemical purity.

The first metal membrane 6 of the electrochemical potential transducer is on the non-copper-coated head with the first contact group 7 and the second coupling cable 8.

Figure 5:
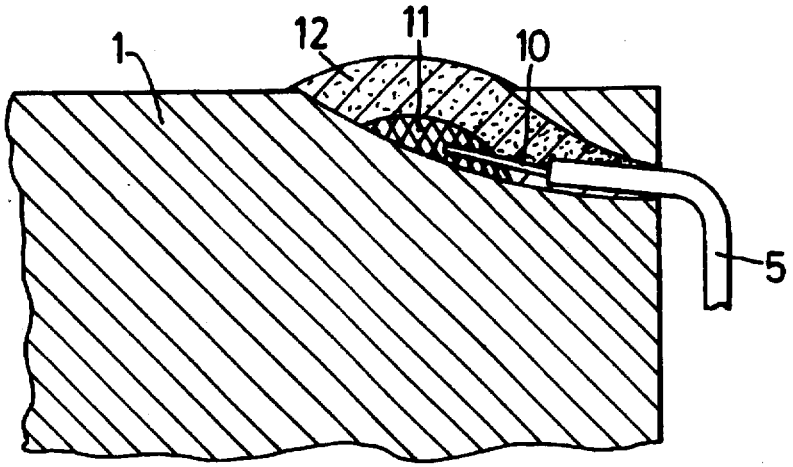
FIGS. 5, 6 and 7 show a first embodiment of the construction of the contact point of the reference electrode.
Figure 6:
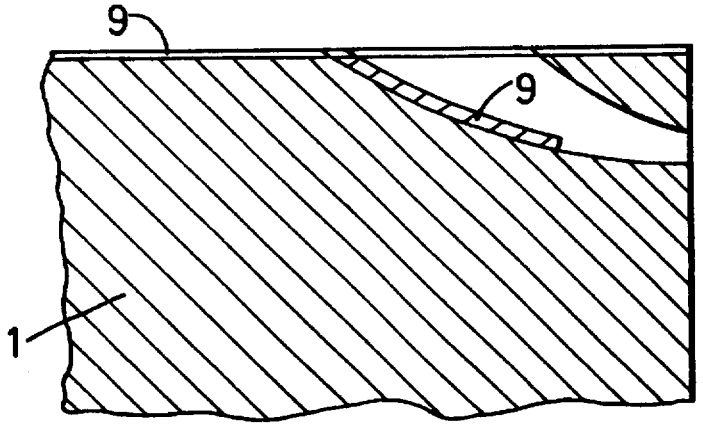
Figure 7:
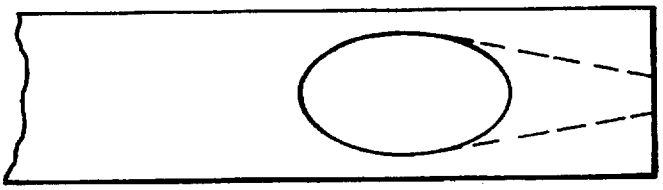
Figure 8:
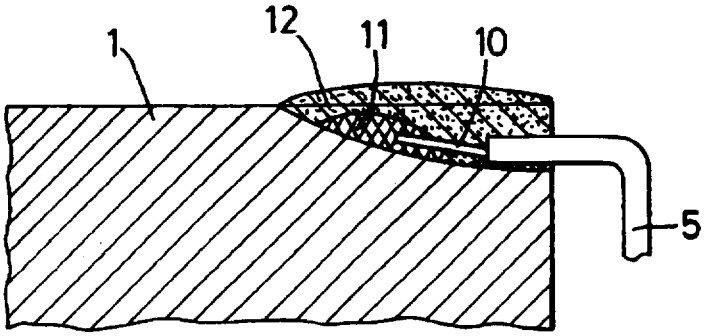

A first embodiment of the construction of the contact group of the reference electrode is represented in FIGS. 5, 6 and 7.

The coupling cable 5, see FIG. 5, is inserted in a conical hole situated between the two faces of the support 1 head below the support 1 corner.

The internal surface of the conical hole is copper-coated, while the electrode 10 of the first coupling cable 5, by means of an alloy 11 inserted by brazing, is electrically coupled with the copper layer 9 situated in the conical hole.

The brazing point and the space inside the conical hole is filled with an insulating compound 12.

To prevent the escape of the insulating compound 12 during the filling operation, the entrance section of the conical hole is equal to the section of the coupling cable 5 including the insulation.

Figure 9:
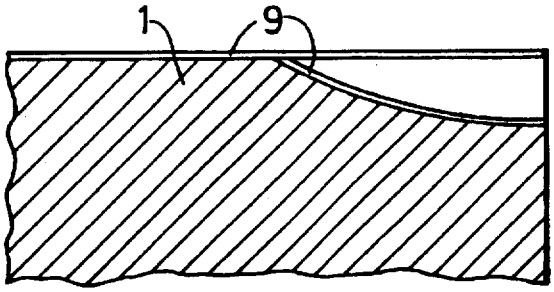
Figure 10:
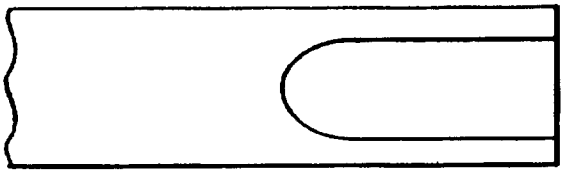
Figure 11:
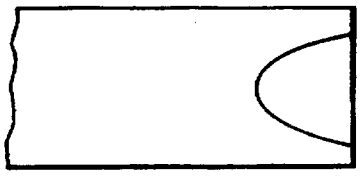

In the second embodiment of the contact group illustrated in FIGS. 8, 9, 10 and 11, on one of the faces of the support 1 head a notch or groove is cut, see FIG. 9, which notch or groove's internal surface, together with the surface of the support 1 head, is copper-coated, which copper 9 is plasma-applied on the support 1.

The electrode 10 of the coupling cable 5 is brazed to the copper layer 9 inside the notch or groove. The whole notch is thus filled with insulating compound 12.

The electrochemical potential transducer, see FIGS. 12, 13 and 14 contains a metal membrane 13 situated on one of the faces of the support 1 head.

The contact group 7 of the electrochemical potential transducer is the same as the contact point group 4 of the reference electrode (see FIG. 5).

The metal membrane 13 of the electrochemical potential transducer is directly applied on the ceramic body, while the electro-conductor wire 14, by means of the alloy 15, is welded by brazing to the metal membrane 13 inside the conical hole which is internally filled with insulating compound 16.

Referring to the first embodiment of the electrode the first contact point group 4 thereof, see FIGS. 15 and 16, is situated on the face of the support 1 head between its edges.

The internal surface of the notch or groove is copper-coated by brazing and contains the electrode 10 wire of the first coupling cable 5. The notch or groove chamber is filled with insulating compound 12.

The second contact group 7 (not shown) for the electrochemical potential transducer is made similarly to the one represented in FIGS. 15 and 16.

As illustrated in FIG. 17, the continuous-action reference electrode 17 is installed close to the underground piping 18 to be protected.

The continuous-action reference electrode 17 is connected to the voltmeter 19 and to the input of the cathodic protection station 20.

The second clamp of the voltmeter 19 is connected to the underground piping 18 and to the input of the cathodic protection station 20.

The outputs of the cathodic protection station 20 are connected to the reference electrode 17 and to the underground piping 18. Integer 21 of FIG. 17 represents an anode earth rod of the cathode protection station 20.

During the measuring of the polarising potential, as illustrated in FIG. 18, because of interrupted polarisation, the continuous-action reference electrode 21 is placed close to the underground piping 18 to be protected and parallel with the said underground piping 18 axis, while the metal membrane 22 of the electrochemical potential transducer is arranged perpendicular to the axis of the underground piping 18.

The coupling cable 5 of the reference electrode 21, the second coupling cable 8 of the electrochemical potential transducer and the clamp of the underground piping 18 are respectively connected to first, second and third clamps of a modulating device 23 which contains a commutator 24, an integrator capacitor 25 and a measuring device 26.

In FIG. 19, which is a diagram of cathodic protection efficiency measurement, the reference electrode 21 with the electrochemical potential transducer 22 are installed in the earth above the insulation fault 27.

The coupling cable 5 of the reference electrode is connected to the first clamp of the voltmeter 19 while the second coupling cable 8 of the electrochemical potential transducer is connected to the first clamp of the milliammeter 28.

The second clamps of the voltmeter 19 and the milliammeter 28 are connected to each other and also to the underground piping 18.

The voltmeter 19 is connected between the continuous-action reference electrode 21 and the underground piping 18 and measures the polarising potential of the said underground piping 18.

The tension measured by the voltmeter 19 reaches the input of the cathodic protection station and increases or reduces the polarising current between the reference electrode 21 and the underground piping 18.

This phenomenon guarantees the continuous polarising potential of the underground piping 18, which prevents its corrosion.

The continuous-action reference electrode 21 can be installed at any point on the surface of the underground piping 18 and requires no maintenance. The whole surface area of the copper plate 2 of FIGS. 1, 2 and 4 at the copper-coated head surface of the support 1 is 1.4–1.8 times larger than the whole surface area of the titanium plates.

The support 1 made of porous sital is impregnated with phreatic electrolyte before being installed in the earth, so no special impregnation is required.

The above-described reference electrodes are more efficient in dry earth, sandy or perfect frozen conditions.

The above-described reference electrodes can also function in sea-water during the measurement of the polarising potential with the interrupted polarisation system illustrated in FIG. 18.

In this case the commutator 24 periodically commutates the metal membrane 22, alternatively at the underground piping 18 and the measuring device 26.

In the meantime the integrator capacitor 25 attenuates the measured tension.

The metal membrane 6, illustrated in FIG. 2, is made of the same material as the underground piping 18: to make it, first the metal dust of the underground piping 18 is produced and then the said underground piping 18 is plasma-dusted on the base of porous ceramic material.

This operation is generally performed in an inert-gas atmosphere.

The production of the plates and their coating on the support 1 is performed by means of special dies.

The metal plate is electrically insulated from the other copper and titanium plates situated on the support 1.

The overall surface of the metal membrane 6 must be not lower than 625 $mm^2$ which is the standard set by various countries.

In order to ensure that there is no contact between the alloy 11 and the ground, the contact group is filled with insulating compound 16, which, when it has become solid, guarantees the mechanical resistance of the contact group.

The contact group illustrated in FIGS. 8 to 11 is simpler to produce with respect to the group illustrated in FIGS. 5 and 12, but it requires special equipment for the solidification of the insulating compound 16.

The cathodic protection efficiency degree definition when no insulation is afforded by means of the external electrode as illustrated in the diagram of FIG. 19 is performed in the following way.

First, the insulation fault 27 point is identified, then, above the fault point, the reference electrode 21 is installed in the earth with the electrochemical potential transducer.

The input of the polarising potential is established by means of the voltmeter 19.

If the value exceeds, for example 0.87 volts, the insulating defect can be cathodically protectible. The surface of the metal membrane 6 as illustrated in FIG. 2 of the electrochemical potential transducer characterises the maximum surface of the insulation fault, protected cathodically with the given measured polarising potential, that is indicated by the maximum allowable value for the surface of the insulation fault.

Plates of nickel alloy may be used in the reference electrode instead of plates of titanium.

In such cases, however, the reference electrode needs firstly to be set to prevent systematic errors.

Before plasma-coating the metal plates on the porous ceramic base, the said base undergoes sand-blasting or equivalent treatment to ensure that the said plasma-coated plates will adhere perfectly.

In order to avoid errors in the measuring of the polarised potential, the thickness of the metal membrane 6, illustrated in FIGS. 2 and 4, must be between 4–5 mm.

By bending the reference electrode a high degree of saving in metal and maintenance is obtained.

Furthermore, having a large surface in contact with the earth, as well as the possibility of great nearness to the underground metal plant to be protected guarantees high interior conductivity of the reference electrode, which permits of increasing the measurement precision of the polarising potential.

The present reference electrode can function in any heat conditions, including constant turning in any ground composition.

Before being installed in the earth the reference electrode is potted with a watery solution of 3% sodium chloride.

If used in rocky ground the reference electrode would be coated with bentonite.

We claim:

1. A continuous-action reference electrode for the cathodic protection of metallic structures, wherein the electrode comprises a support (1) substantially plate-shaped and made of ceramic material porous to electrolyte having the function of a base for a first plate (2) having the function of an electrode, said first plate (2) being made of a first material in a group consisting of copper, nickel and nickel-based alloy, said first plate (2) being situated on both flat faces of said ceramic support (1) and for a second plate (3) having the function of an electrode, said second plate (3) being made of a second material in a group consisting of titanium, nickel and nickel-based alloy, said second plate (3) bring isolated from said first plate (2) on both flat faces, said plates (2), (3) being made of dissimilar materials; an electric connection for both said plates (2), (3) being realized by means of connection to a further copper plate applied on a lateral face of said support (1); the arrangement of said first and second plates (2), (3) on the flat surfaces of said support (1) being such that said first plate (2) on a flat surface corresponds to said second plate (3) on an opposite surface; a metal membrane (6) constituting an electrochemical potential transducer being situated on a lateral face of the support (1) and being electrically isolated from the other metal plates of said support (1), said membrane being made of the same material as the metallic structure(s).

2. A reference electrode as claimed in claim 1, wherein the total surface of said first plates (2) is more than the total surface of said second plates (3) by 1.4 to 1.8 times.

3. A reference electrode as claimed in claim 1, wherein the plate-shaped support (1) is made of Sital porous ceramic material.

4. A reference electrode as claimed in claim 1, wherein said plates (2) and (3) are flat-spiral shaped, said spirals being split into spiral couples, one spiral of said couples being of the first material and one of the second material, each spiral of said couples being of different length and width and being connected together and to a coupling cable (5); said couples of spirals being situated on two flat surfaces of said support (1) in such a way that one spiral of the first material on one flat surface of said support (1) corresponds to one spiral of the second material situated on a flat surface of the opposite face of said (1).

5. A reference electrode as claimed in any one of claims 1–4, further comprising a first and second contact, respectively (7) and (4), made in a conical hole situated between two adjacent faces of the support (1) and below a corner of said support (1), for which reason the conical hole interior part is covered with a layer of copper to which is welded an electroconductor wire for which is welded an electroconductor wire for the first and the second coupling cables to a cathodic protection station; the chamber constituted by the conical hole being filled with an electrically isolating compound, the first contact (7) being connected with the first metal membrane (6), the second contact (4) being connected with the second plate (3).

6. A reference electrode as claimed in any one of claims 1–4, further comprising a first and second group of contacts made in a groove situated on one lateral face of said support (1), the groove internal surface being covered with copper to which copper is soldered an electroconductor wire of the first and second coupling cables (5), said groove being filled with an insulating compound.

7. A reference electrode as claimed in any one of claims 1–4, wherein said first and second plates (2), (3) are applied to the ceramic support (1) by means of a plasma process or by means of potting or another type of coating aimed at creating a uniform thickness over the surface.

8. A reference electrode as claimed in any one of claims 1–4, further comprising a first and second contact, respectively (7) and (4), made in a conical hole situated between two adjacent faces of the support (1) and below a corner of said support (1), for which reason the conical hole interior part is covered with a layer of copper to which is welded an electroconductor wire for which is welded an electroconductor wire for the first and the second coupling cables to a cathodic protection station; the chamber constituted by the conical hole being filed with an electrically isolating compound, the first contact (7) being connected with the first metal membrane (6), the second contact (4) being connected with the second plate (3); and wherein said first and second plates (2), (3) are applied to the ceramic support (1) by means of a plasma process or by means of potting or another type of coating aimed at creating a uniform thickness over the surface.

9. A reference electrode as claimed in any one of claims 1–4, further comprising a first and second group of contacts made in a groove situated on one lateral face of said support (1), the groove internal surface being covered with copper to which copper is soldered an electroconductor wire of the first and second coupling cables (5), said groove being filled with an insulating compound; and wherein said first and second plates (2), (3) are applied to the ceramic support (1) by means of a plasma process or by means of potting or another type of coating aimed at creating a uniform thickness over the surface.

* * * * *